US005144760A

United States Patent [19]

McGuire

[11] Patent Number: 5,144,760

[45] Date of Patent: Sep. 8, 1992

[54] TRENCHER

[75] Inventor: Brian E. McGuire, Oldham, England

[73] Assignee: British Gas PLC, England

[21] Appl. No.: 670,896

[22] Filed: Mar. 18, 1991

[30] Foreign Application Priority Data

Mar. 26, 1990 [GB] United Kingdom ..... 9006710.9

[51] Int. Cl.[5] ..... E02F 5/08

[52] U.S. Cl. ..... 37/80 A; 37/94; 37/98; 37/189; 37/DIG. 18; 405/182

[58] Field of Search ..... 37/80 A, 94, 98, 189, 37/DIG. 18, 91; 405/182; 172/40

[56] References Cited

U.S. PATENT DOCUMENTS

| | | | |
|---|---|---|---|
| 295,281 | 3/1884 | Purcell | 37/94 |
| 887,129 | 5/1908 | Rolph | 37/94 |
| 3,510,970 | 5/1970 | Mikhailov | 37/98 |
| 3,563,045 | 2/1971 | Hansen | 405/184 |
| 3,727,331 | 4/1973 | Hansen | 172/40 X |
| 3,994,081 | 11/1976 | Middleton | 37/DIG. 18 |
| 4,611,667 | 9/1986 | Tharp | 172/40 |

FOREIGN PATENT DOCUMENTS

| | | | |
|---|---|---|---|
| 383803 | 8/1973 | U.S.S.R. | 37/94 |
| 1281643 | 1/1987 | U.S.S.R. | 37/91 |
| 878807 | 1/1960 | United Kingdom . | |
| 1151736 | 6/1966 | United Kingdom . | |

*Primary Examiner*—Randolph A. Reese
*Assistant Examiner*—Arlen L. Olsen
*Attorney, Agent, or Firm*—Larson and Taylor

[57] ABSTRACT

A trencher comprises a ground running, powered vehicle which travels in a forward direction carrying a trenching wheel driven by power to rotate in a vertical plane containing the forward direction so that cutting tips on the wheel's periphery excavate spoil from the ground leaving a trench therebehind. A plough just behind the front end of the trenching wheel pushes the spoil aside from the trench. The plough comprises two blades in V-shaped disposition, each blade being at a respective opposite side of the trenching wheel with leading ends of the plough blades being nearer sides of the wheel then their trailing ends. The plough blades, which are vibrated by vibrators driven by hydraulic motors, are mounted by elastically deformable anti-vibration mountings on respective supporting plates alongside the plough blades. The plough blades and these plates are raisable and lowerable hydraulically, and can be held braced in any desired V-shape by hydraulic struts.

13 Claims, 1 Drawing Sheet

TRENCHER

This invention concerns a trencher.

A trencher is a trench digging machine in the form of a powered vehicle arranged to be driven under power along the ground, the vehicle being provided with powered rotating digging apparatus which is rotated under power and is propelled by the vehicle along the ground to dig a trench therein having a length which increases as the vehicle and digging apparatus progress.

The vehicle may run on wheels at least some of which are driven, and/or it may be a track laying vehicle running on driven, endless tracks.

The digging apparatus may comprise a driven wheel having a plurality of digging projections or cutter tips on its periphery which is applied to the ground to dig the trench. Or the digging apparatus may be an endless chain or belt bearing the digging projections or cutter tips on its outer side and driven along upper and lower runs so as to rotate about a pair of rollers or sprockets at opposite ends of the runs which may be inclined to the horizontal so that a said roller or sprocket at one end of the runs is lower than the other roller or sprocket at the other end of said runs.

It is known for the vehicle to act as a tractor pulling the digging apparatus along so that spoil excavated from the trench is thrown or pushed up somewhat in advance of the digging apparatus and into space between the digging apparatus and a rear part of the vehicle. With a view to placing the spoil clear of the trench being dug a plough in the form of two plough blades in a generally V-shaped disposition is mounted on the vehicle in a position just behind a front end of the digging apparatus and at substantially ground level so that as the vehicle proceeds the plough encounters the newly excavated spoil and pushes it over the ground surface to either side of the trench being dug.

The known digging apparatus can operate to produce very quickly large amounts of spoil which causes the underneath of the vehicle to become flooded with considerable quantities of the spoil which acts on lower parts of the vehicle to exert drag and impede its progress. Also the plough finds it difficult, and sometimes almost impossible, to push aside the large amount of spoil it is required to deal with. All this places considerable strains on the vehicle and the connections between it and the digging apparatus. Furthermore to propel the vehicle forwards in this difficult situation requires more of the power output from a power source on the vehicle than is desirable, because it means that an additional proportion of the power that would be better used to drive the digging apparatus is required to drive the vehicle. Accordingly with respect to an efficient use of energy the trench digging process is performed less efficiently.

An object of the invention is to provide a trencher which can more easily and quickly move aside the newly excavated spoil.

SUMMARY OF THE INVENTION

According to the invention a trencher comprises a powered vehicle for driving under power along the ground, said vehicle being provided with powered rotating digging apparatus, said digging apparatus being propelled along the ground by said vehicle and rotated under power for digging in the ground a trench having a length which increases as said vehicle and digging apparatus progress, said vehicle being provided with plough means which move with the vehicle and encounter spoil newly dug from the trench and lying on the ground surface and push said spoil aside from the trench being dug, said plough means comprising at least one plough blade mounted on said vehicle by mounting means allowing relative movement between said blade and said vehicle, and powered vibratory motion producing means to apply vibratory output motion therefrom to said plough blade to cause said plough blade to vibrate on said mounting means relative to said vehicle and spoil.

Taking the direction of said progress of the vehicle as a forward path, said plough blade may be disposed behind a leading portion of said digging apparatus so as to be preceded by said leading portion.

Said vibratory motion producing means may comprise a vibrator driven by motor means.

Preferably said plough blade is raisable and lowerable relative to the digging apparatus. This raising and lowering may be by operation of fluid powered actuating means. If desired, said plough blade may raisable and lowerable whereby said blade is tiltable for positioning said blade with its longitudinal axis inclined to the horizontal.

Taking the direction of said progress as progress along a or said forward path said plough blade has a leading end and a trailing end to which said plough blade extends from said leading end along a direction diverging from said path.

A strut may be provided a to act as a brace to said plough blade to brace the latter at a pre-determined angle of divergence to said path.

The strut may be of selectively variable length to vary said angle of divergence.

BRIEF DESCRIPTION OF THE DRAWINGS

The invention will now be further described, by way of example, with reference to the accompanying drawing in which.

DETAILED DESCRIPTION OF A PREFERRED EMBODIMENT

Figure 1:
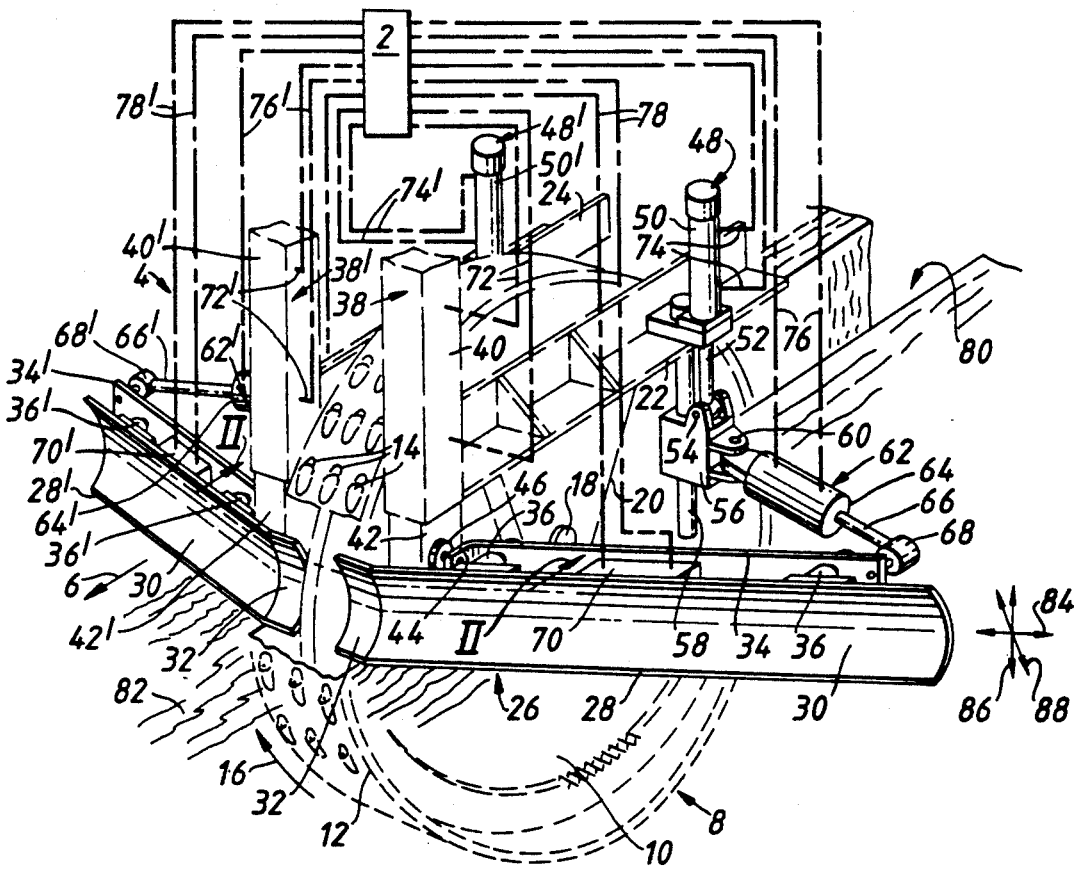
FIG. 1 is a fragmentary view of a fragment of an embodiment of a trencher formed according to the invention.
Figure 2:
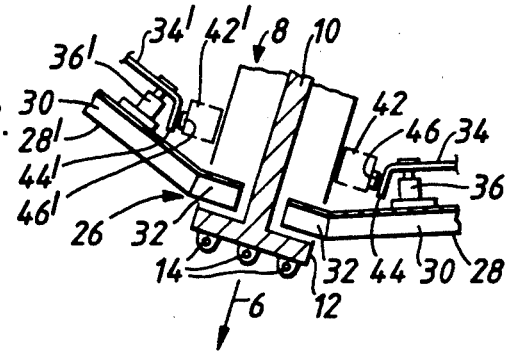
FIG. 2 is a fragmentary section on line II—II in FIG. 1.

The trencher concerned comprises a powered vehicle to travel along the surface of the ground. The source of power may be an internal combustion engine carried by the vehicle and arranged to drive some or all of vehicle's ground running wheels if the vehicle runs on wheels or to drive endless driving tracks if the vehicle is a track laying vehicle. The power source of the vehicle is also arranged to drive pump means providing a supply of pressurised fluid for a pressurised fluid supply and control system shown at 2 in the accompanying drawing. That supply and control system can be a pressurised gas system, for example a pneumatic system, or, as shown, an hydraulic system.

With reference to the accompanying drawing a trench digging apparatus is indicated at 4, mounted at the rear of the aforesaid vehicle which is travelling in the direction of arrow 6. The digging apparatus 4 comprises a trenching wheel 8 formed by spokes or a central disc-shaped web 10 disposed in a substantially vertical plane and having a peripheral rim 12 on which is mounted a plurality of cutting tools provided by digging projections or cutter tips 14 pointing in the direction 16 of wheel rotation about an horizontal axle 18 supported in brackets 20 (one shown) on chassis members 22 and 24 of the digging apparatus, wherein the chassis comprises the members 22 and 24 secured together. An hydraulic motor (not shown) is arranged to drive the trenching wheel 8 in the direction 16, the motor being supplied with hydraulic motive fluid under pressure from the supply and control system 2.

Control arms (not shown) are pivotably mounted at one end on the rear of the vehicle and are secured at the other end to the chassis 22,24. The control arms are pivotably raisable and lowerable under the action of hydraulic jacks to raise and lower the trenching wheel 8 so that it can be set to excavate a trench of the desired depth. If desired, the control arms may be extendable and retractable hydraulically.

A plough 26 is provided and comprises a pair of plough blades 28 and 28$^1$ disposed in a generally V-shaped array. Each plough blade has a curved cross-section in a plane at right-angles to a longitudinal axis of the blade and main portion 30 extending generally rearwardly from and at a reflex angle to a leading end portion 32 facing generally forwardly. The spokes or wheel web 10 extend(s) between the two blade end portions 32 which are disposed near the rim 12 which extends to either side of the spokes or the wheel web 10 and thus overlies the leading end portions 32.

Accordingly as the trenching wheel 8 travels in the forward direction 6, the trenching wheel has a leading portion which precedes the plough blades 28 and 28$^1$. In the arrangement shown in FIG. 1 that leading portion of the trenching wheel is part of the rim 12 adjacent to the plough blade ends 32 and substantially at one end of the horizontal diameter of the wheel 8.

Each plough blade 28 or 28$^1$ is mounted on a respective supporting plate 34 or 34$^1$ by means of respective pairs of anti-vibration mountings 36 or 36$^1$ which allow each plough blade to perform a limited amount of universal movement relative to the respective supporting plate 34 or 34$^1$. Each vibration mounting 36,36$^1$ may comprise an internal first metal sleeve to which is bonded a surrounding rubber sleeve in turn surrounded by an outer, second metal sleeve bonded to the rubber, the mountings being thus capable of some elastic deformation.

At its front end the chassis 22,24 has mounted thereon two vertical hydraulic actuators 38 and 38$^1$ each formed by a double acting piston and cylinder unit comprising a respective cylinder 40 and 40$^1$ and a respective piston rod 42 or 42$^1$. Each supporting plate 34 or 34$^1$ has a respective flange 44 or 44$^1$ connected to the corresponding piston rod 42 or 42$^1$ by a respective universal joint 46 or 46$^1$, for example a ball and socket joint.

Towards its rear end the chassis 22,24 has mounted thereon two vertical hydraulic actuators 48 and 48$^1$ each formed by a double acting piston and cylinder unit comprising a respective cylinder 50 or 50$^1$ and a respective piston rod (only one shown at 52). Each of these piston rods is pivotably connected at 54 at its lower end to a respective block (only one shown at 56) adapted to slide vertically along a respective vertical stationary guide rail or rod (only one shown at 58) engaged in a bore through the block and mounted at the upper end of the stationary guide rail on the chassis 22,24.

The block 56 is connected through a vertical pivot 60 to an horizontal strut 62. The other block (not shown) is similarly connected to another horizontal strut 62$^1$. Each strut 62,62$^1$ is extensible and retractable and comprises a double acting hydraulic piston and cylinder unit comprising a cylinder 64 or 64$^1$ and a respective piston rod 66 or 66$^1$ connected to a respective universal joint 68 or 68$^1$ (for example a ball joint) mounted on the adjacent to an outer trailing end of the respective supporting plate 34 or 34$^1$.

Powered, vibratory motion producing means 70 or 70$^1$ is mounted on the back of the plough blade 28 or 28$^1$ respectively. Each vibratory motion producing means can be a vibrator 70 or 70$^1$ comprising a vibratory motion producing device acting on the respective plough blade) and an hydraulic motor rotatably driving the vibratory motor producing device.

Hydraulic lines connecting the actuators 38 and 48, the strut 62, and the motor of the vibrator 70 to the supply and control system 2 are indicated at 72,74,76 and 78 respectively, by chain-dotted lines. Likewise, hydraulic lines connecting the actuators 38$^1$ and 48$^1$, the strut 62$^1$ and the motor of the vibrator 70$^1$ to the supply and control system 2 are indicated at 72$^1$, 74$^1$, 76$^1$ and 78$^1$ respectively.

To dig a trench 80 in the ground 82 the trenching wheel 8 is rotated under power in the direction 16 and the control arms actuated until the bottom of the wheel digs down into the ground by the amount necessary to dig a trench of the desired depth. Then the vehicle moves forwards in the direction 6 drawing the rotating trenching wheel 8 along to leave behind a dug trench 80 of the desired depth.

By using the control system 2 to operate the actuators 38,38$^1$, 48 and 48$^1$ the supporting plates 34 34$^1$ are raised or lowered relative to the wheel axle 18 so that the plough blades 28,28$^1$, are positioned at a desired height above the surface of the ground 82 when the trenching wheel 8 is digging a trench of the desired depth.

The control system 2 also supplies hydraulic motive fluid to the vibrators 70 and 70$^1$ to vibrate the plough blades 28,28$^1$ on their elastically deformable mountings 36,36$^1$ so that the blades vibrate relatively to the chassis 22,24 and to the vehicle. The vibratory motion imparted to each plough blade may have:

(i) components in opposite horizontal directions along the plough blade (such as indicated by double headed arrow 84 for the blade 28);

(ii) components in opposite vertical directions perpendicular to the longitudinal axis of the plough blade (such as indicated by double headed arrow 86 for the blade 28), and (iii) components in opposite horizontal directions 88 perpendicular to the longitudinal axis of the plough blades (such as indicated by the double headed arrow 88 for the blade 28).

As the trenching wheel 8 moves forwards in direction 6 the plough 26 encounters the excavated material thrown up in front of the wheel and lying on the surface of the ground. As they move forwards with the wheel 8, the plough blades 28,28$^1$ push the excavated material to either side of the trench being dug. The vibrating plough blades tend to loosen the excavated spoil and semi-fluidise the spoil thus making it easier for the plough blades to move the excavated material aside.

The control system 2 can be operated to operate the struts 62,62$^1$ by extending or retracting them individually or simultaneously to pivot one or both supporting plates 34,34$^1$ about the respective universal joint 46 or 46$^1$ so that the particular shape of the V-shaped disposition of the two plough blades 28,28[1] can be varied, as desired and the plough blades then braced in that disposition by the struts.

Also the actuators 38,38[1], 48, 48[1] can be operated by the control system 2 simultaneously, or individually or in any desired combination, for example in pairs, i.e. the actuators 38 and 38[1], or the actuators 48 and 48[1], or the actuators 38 and 48, or the actuators 38[1] and 48[1], can be operated simultaneously. The actuators may be operated to position both or either plough blade horizontally or to pivot a plough blade about the respective universal joint 46 or 46[1] so that the plough blade adopts a position in which its longitudinal axis is at an angle to the horizontal.

The control system 2 can be operated in response to instructions from a driver of the vehicle.

The struts 62 and 62[1] can be maintained in any desired extended or retracted state. If desired the struts 62,62[1] of variable length can be substituted by struts of fixed length, for example metal rods or tubes.

I claim:

1. A trencher comprising a powered vehicle for driving under power along the ground, said vehicle being provided with powered rotating digging apparatus, said digging apparatus being propelled along the ground by said vehicle and rotated under power for digging in the ground a trench having a length which increases as said vehicle and digging apparatus progress, said vehicle being provided with a plough means, movable with said vehicle so as to encounter spoil newly dug from the trench and lying on the ground surface, for pushing said spoil aside from the trench being dug, said plough means comprising at least one plough blade mounted on said vehicle by mounting means allowing relative movement between said blade and said vehicle, powered vibratory motion producing means for applying vibratory output motion therefrom to said plough blade to cause said plow blade to vibrate on said mounting means relative to said vehicle and the spoil, and, taking the direction of progress of the vehicle as progress along a forward path, said plough blade having in relation to said forward path, a leading end and an opposite trailing end to which said plough blade extends from said leading end along a direction diverging from said path, said vehicle further including a first fluid powered actuating means for raising and lowering said leading end of the plough blade relative to the digging apparatus, and a second fluid powered actuating means for raising and lowering the trailing end of said plough blade relative to the digging apparatus.

2. A trencher according to claim 1, wherein, taking the direction of said progress of the vehicle as progress along said forward path, said plough blade is disposed behind a leading portion of said digging apparatus so as to be preceded by said leading portion.

3. A trencher according to claim 1, wherein said mounting means are elastically deformable.

4. A trencher according to claim 3, wherein said mounting means comprises a plurality of anti-vibration mountings.

5. A trencher according to claim 1, wherein said vibratory motion producing means comprises a vibrator driven by motor means.

6. A trencher according to claim 5, wherein said motor means is driven by motive fluid.

7. A trencher according to claim 1, wherein said plough blade is raisable and lowerable whereby said blade is tiltable for positioning said blade with its longitudinal axis inclined to the horizontal.

8. A trencher according to claim 1, wherein a strut braces said plough blade whereby the plough blade is at a pre-determined angle of divergence to said path.

9. A trencher according to claim 8, wherein said strut is of selectively variable length for varying said angle of divergence.

10. A trencher according to claim 9, wherein said strut is operated by motive fluid to vary the length of said strut.

11. A trencher according to claim 8, wherein said digging apparatus comprises a trenching wheel which is rotated under power and has a rim carrying cutting tools for digging the trench, and said leading end of said plough blade is disposed just behind said rim and in front of the axis of wheel rotation, whereby said rim overlies said leading end.

12. A trencher according to claim 1, wherein two said plough blades are provided, and each said plough blade is disposed on a respective opposite side of said digging apparatus.

13. A trencher according to claim 1, wherein said digging apparatus comprises a trenching wheel which is rotated under power and has a periphery adapted to dig the trench.

* * * * *